United States Patent [19]

Azuhata et al.

[11] Patent Number: 4,515,094

[45] Date of Patent: May 7, 1985

[54] FUEL JET METHOD AND APPARATUS FOR PULVERIZED COAL BURNER

[75] Inventors: Shigeru Azuhata; Norio Arashi, both of Hitachi; Kiyoshi Narato, Ibaraki; Tooru Inada, Hitachi; Kenichi Souma, Hitachi; Keizou Ohtsuka, Hitachi; Yukio Hishinuma, Hitachi; Tadahisa Masai, Kure, all of Japan

[73] Assignee: Hitachi, Ltd., Tokyo, Japan

[21] Appl. No.: 560,179

[22] Filed: Dec. 12, 1983

[30] Foreign Application Priority Data

Dec. 27, 1982 [JP] Japan ..... 57-226907

[51] Int. Cl.[3] ..... F23K 5/00

[52] U.S. Cl. ..... 110/347; 110/262; 110/263; 110/264

[58] Field of Search ..... 110/260–263, 110/265, 347, 244

[56] References Cited

U.S. PATENT DOCUMENTS

| | | | |
|---|---|---|---|
| 1,910,735 | 5/1933 | Zikesch | 110/265 |
| 2,738,776 | 3/1956 | Burg | 110/264 |
| 2,979,000 | 4/1961 | Sifrin et al. | 110/265 |
| 4,147,116 | 4/1979 | Graybill | 110/263 |
| 4,206,712 | 6/1980 | Vatsky | 110/264 |
| 4,333,405 | 6/1982 | Michelfelder et al. | 110/347 |
| 4,367,686 | 1/1983 | Adrian | 110/347 |
| 4,377,978 | 3/1983 | Eusner | 110/262 |
| 4,422,389 | 12/1983 | Schroder | 110/264 |
| 4,428,309 | 1/1984 | Chang | 110/262 |
| 4,438,709 | 3/1984 | Bono et al. | 110/263 |

FOREIGN PATENT DOCUMENTS 54-105031 1/1979 Japan .

*Primary Examiner*—Henry C. Yuen

*Attorney, Agent, or Firm*—Antonelli, Terry & Wands

[57] ABSTRACT

There are the primary fuel nozzle for jetting the first coal in the fine powder form with an air ratio up to 1, and the secondary fuel nozzle for jetting the second coal in the fine powder form with an air ratio at least 1 from the outer circumferential portion of the primary fuel nozzle. Swirl means are located at the top of the secondary fuel nozzle for swirling the second coal.

1 Claim, 11 Drawing Figures

FUEL JET METHOD AND APPARATUS FOR PULVERIZED COAL BURNER

BACKGROUND OF THE INVENTION

1. Field of the Invention

The present invention relates to a fuel burner for coal in the fine powder form (hereinafter referred to as the pulverized coal) used for boilers.

2. Description of the Prior Art

Fossile fuels contain the nitrogen (N) component besides the fuel components such as carbon and hydrogen. In the case of coal in particular, the N content is great in comparison with gas fuels and liquid fuels. Hence, the quantity of the nitrogen oxides (hereinafter referred to as $NO_x$) generated upon combustion of coal is greater than when a liquid fuel is burnt, and it has been desired to reduce this $NO_x$ as much as possible.

Conventional combustion methods to restrict the formation of $NO_x$ include a two-stage combustion method which arranges the primary fuel nozzle jetting the first fuel with a smaller air ratio at an inner cylindrical portion and the second fuel nozzle jetting the second fuel with a large air ratio at an outer cylindrical portion which is located at the outer circumferential portion of the inner cylindrical portion.

Japanese Laid Open Utility-model Application No. 54-105031 (1979), published on July 24, 1979, "Previously mixed combustion burner" is concerned with such a two-stage combustion method.

There is enthusiastic desire to supply a fuel and air jet method and apparatus for a pulverized coal, lower $NO_x$ burner which is particularly suitable for reducing much of the $NO_x$ generated at the combustion of the pulverized coal.

SUMMARY OF THE INVENTION

An object of the present invention is to provide a method and apparatus which is suitable for reducing $NO_x$ generated at combustion of the pulverized coal.

The fuel jet method for a low $NO_x$ burner in accordance with the present invention is characterized in that the first coal in the fine powder form with an air ratio up to 1 is jetted from an inner cylindrical portion, and the second coal in the fine powder form with an air ratio of at least 1 is jetted and swirled from an outer cylindrical portion.

The fuel jet apparatus for a low $NO_x$ burner in accordance with the present invention is characterized in that the apparatus comprises an primary fuel nozzle for jetting the first coal in the fine powder form by means of air at an inner cylindrical portion, an secondary fuel nozzle for jetting the second coal in the fine powder form disposed around an outer cylindrical portion which is located at the outer circumferential portion of the inner cylindrical portion, and swirl means for swirling the second coal at the point of the secondary fuel nozzle.

The combustible components in the coal can be broadly classified into a volatile component and a solid component. In accordance with the properties inherent to the coal, the combustion mechanism of the pulverized coal consists of a pyrolytic process where the volatile component is emitted and a combustion process where the combustible solid component (hereinafter referred to as the "char") is burnt after the pyrolysis. The combustion speed of the volatile component is higher than that of the solid component and the volatile component is burnt at the initial stage of combustion. During the pyrolytic process, the N content contained in the coal is also divided into the part which is emitted upon evaporation and the part which remains in the char, in the same way as other combustible components. Accordingly, fuel $NO_x$ generated at the time of combustion of the pulverized coal is divided into $NO_x$ from the volatile N content and $NO_x$ from the N content in the char.

The volatile N changes to compounds such as $NH_3$ and HCN at the initial stage of combustion and in the combustion range in which oxygen is lean. These nitrogen compounds partly react with oxygen to form $NO_x$ and partly react with the resulting $NO_x$ to form a reducing agent which decomposes $NO_x$ to nitrogen. This $NO_x$ reducing reaction due to the nitrogen compounds proceeds in a system in which $NO_x$ is co-present. In a reaction system where $NO_x$ does not exist, however, most of the nitrogen compounds are oxidized to $NO_x$. This reducing reaction proceeds more easily in a lower oxygen concentration atmosphere.

The formation quantity of $NO_x$ from the char is smaller than $NO_x$ from the volatile component, but in accordance with the conventional two-stage combustion method, it is not possible to restrict $NO_x$ from the char. In order to restrict $NO_x$ from the char, it is effective to emit once the N component in the char as the gas and to reduce the substances emitted this time as $NO_x$ to nitrogen using a reducing substance. To emit the N component in the char as the gas, it is necessary to completely burn the char and hence, the formation of complete combustion range is indispensable as the low $NO_x$ combustion method of the pulverized coal.

As can be understood clearly from the explanation described above, an effective combustion method which reduces $NO_x$ at the time of combustion of the pulverized coal will be one that permits the co-presence of the char, $NO_x$ and reducing nitrogen compounds so as to reduce $NO_x$ to nitrogen by the reducing nitrogen compounds. In other words, it is an effective combustion method which utilizes the nitrogen compounds as the precursor of $NO_x$ for reducing $NO_x$ to nitrogen and thus extinguishes the resulting $NO_x$ as well as the $NO_x$ precursor.

To accomplish ideal formation of the reducing agent and $NO_x$ and mixing of them, however, it is necessary to eliminate the mutual interference between the formation region of the reducing agent and the $NO_x$ formation region, that is, to mix the resulting products from each region after the end of the reaction in each reaction region. In other words, it is necessary to reduce mixing in each region at the intermediate stage of reaction.

It is further necessary to promote the reaction in the air-lean combustion region and to improve mixing of the reaction product from the air-lean region and the reaction product from the complete combustion region so as to improve the $NO_x$ reduction effect.

The method of our present invention comprises the step of carrying out combustion bringing the second pulverized coal from the secondary fuel nozzle to the level of an air ratio of at least 1, the step of forming the reduction region of an air ratio of up to 1 by feeding the first pulverized coal from the primary fuel nozzle so as to reduce the resulting $NO_x$, and the step of swirling the second pulverized coal for preventing the second pulverized coal from being mixed immediately into the region where the thermal resolution of the primary pulverized coal occurs.

According to the present invention, each combustion region formed by the first and second coals or the primary and secondary fuel nozzles being divided clearly, the present invention can reduce $NO_x$ generated at the combustion of the pulverized coal.

DESCRIPTION OF THE PREFERRED EMBODIMENTS

Figure 1:
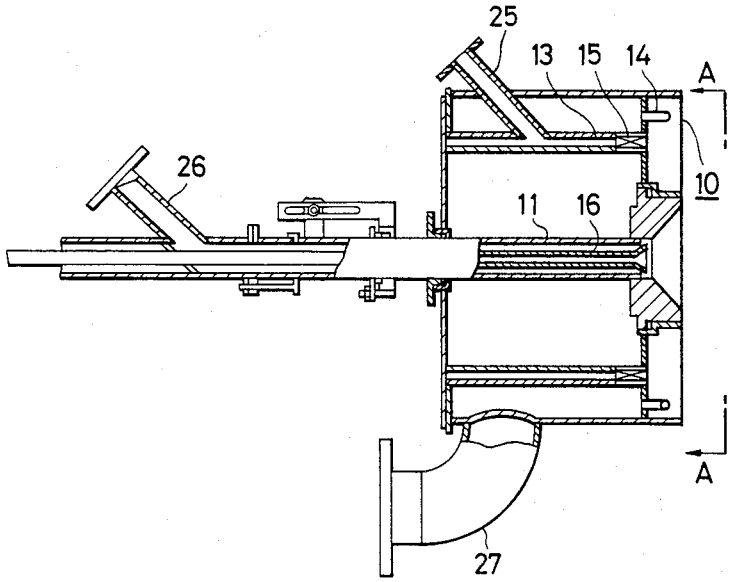
FIG. 1 is a longitudinal sectional view of a pulverized coal burner in accordance with one embodiment of the present invention.
Figure 2:
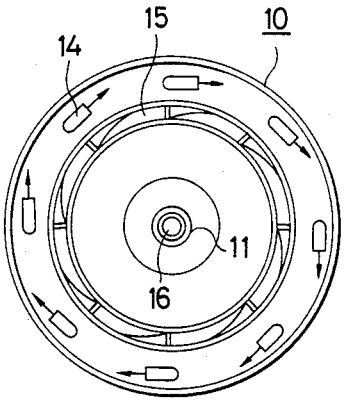
FIG. 2 is a sectional view taken along line A—A of FIG. 1.

In FIGS. 1 and 2, a coal burner 10 according to the invention is shown as comprising a primary fuel nozzle 11 for jetting pulverized coal and a secondary fuel nozzle 13 for jetting pulverized coal. The nozzle 13 is disposed concentrically with the primary fuel nozzle around the outer circumference thereof. The secondary fuel nozzle 13 has a swirl flow generator 15 of an axial flow type which is coated with ceramic and which swirls and jets the pulverized coal. Reference numeral 14 represents air nozzles disposed around the outer circumference of the secondary fuel nozzle. In this embodiment, eight air nozzles are disposed equidistantly around the secondary fuel nozzle 13. The angle of inclination of the swirl flow generator 15 and air nozzles 14 is within the range of 45° to 90° along the axis of the burner 10. Reference numeral 16 represents a cylindrical boiler preheating fuel jet nozzle disposed at the center of the primary fuel nozzle 11. At the time of preheating of a combustion furnace at the start, it jets the gas fuel for combustion. The air is used for transporting the pulverized coal and the primary and secondary fuel nozzles 11 and 13 jet the pulverized coal as such. The swirling speed of the air jetted from the air nozzles is higher than that of the pulverized coal jetted from the secondary fuel nozzle 13. These members 11 through 16 constitute the burner 10 of the present invention.

Figure 3:
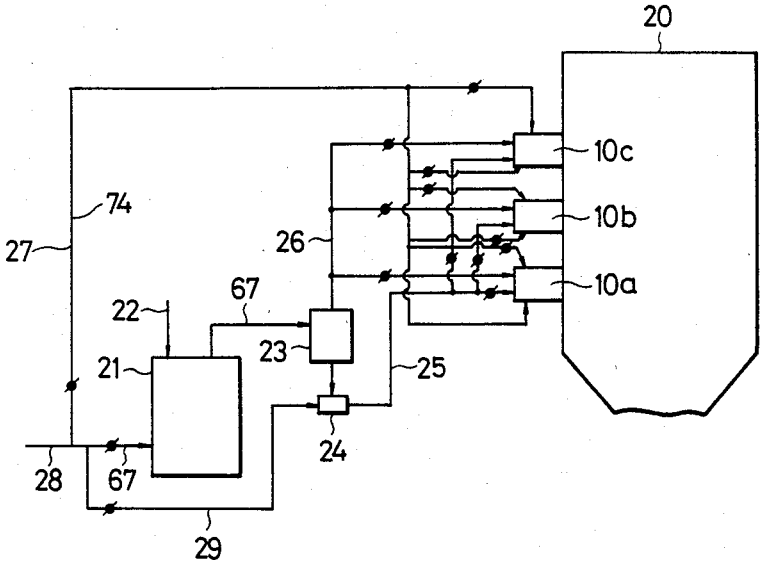
FIG. 3 is a flow chart of a combustion apparatus using the burner of the present invention.

FIG. 3 illustrates an example of a pulverized coal combustion apparatus using the burner 10 of the present invention. A plurality of burners 10*a*, 10*b*, 10*c* of the invention are disposed in the direction of height of a boiler 20. Reference numeral 21 represents a pulverizer which pulverizes the coal 22 as the fuel. In the case of ordinary combustion, it pulverizes the coal so that coal having a particle size of up to 74 $\mu$m accounts for about 80%.

Reference numeral 23 represents a separator which separates the pulverized coal in accordance with the particle size. This separator 23 may be a cyclon separator or a louver separator. Reference numeral 24 represents an ejector disposed below the separator 23 and supplying the coarse coal separated by the separator 23 to the secondary fuel nozzle of the burners 10*a*, 10*b*, 10*c* from a tube 25 by the air. The fine coal separated by the separator 23 is also supplied from a tube 26 to the primary fuel nozzles of the burners 10*a*, 10*b*, 10*c* by means of the air in the same way. Reference numeral 27 represents a tube for feeding the air to the air nozzles of the burners 10*a*, 10*b*, 10*c* and this tube 27 branches from a main tube 28. Reference numeral 29 represents a tube which also branches from the main tube 28 and has its other end connected to the ejector 24.

In the construction described above, the gas fuel is jetted from the boiler preheating jet nozzle 16 for combustion at the start of operation of the boiler 20. After the temperature inside the boiler 20 reaches a predetermined temperature, the jet of the gas fuel is stopped and the pulverized coal is jetted from the primary and secondary nozzles 11, 13 of each burner 10*a*, 10*b*, 10*c*. Then, the combustion is effected.

Figure 4:
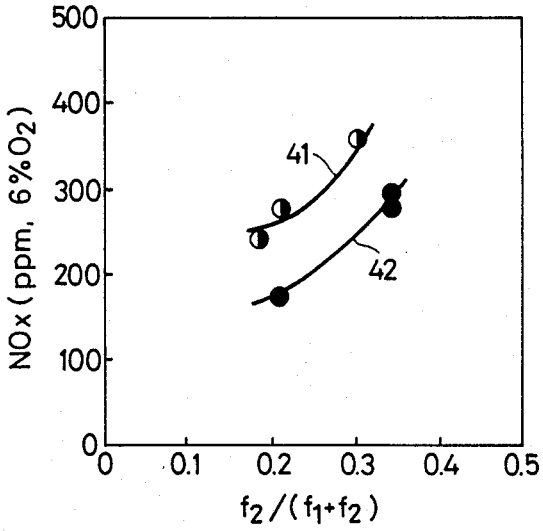
FIG. 4 is a graph showing the relation between the secondary fuel ratio and $NO_x$ when the coal is burnt using the burner of the present invention.

FIG. 4 shows the relation between the secondary fuel ratio, the amount of secondary fuel $f_2$ per the amount of the primary fuel $f_1$ plus the amount of the secondary fuel $f_2$, and $NO_x$, when the air nozzles 14 shown in FIGS. 1 and 2 are removed. In FIG. 4, 41 shows the characteristic curve when the swirl flow generator 15 is not used and the speed $V_1$ of the first fuel jetted from the primary fuel nozzle 11 is 23 m/sec, and 42 represents the characteristic curve when the angle of the inclination of the swirl 15 is 60° along the axis of the burner 10 and the speed $V_1$ of the first fuel is also 23 m/sec.

The coal used is Taiheiyo Coal of Japan, which is pulverized into a particle size such that about 80% passes through a 200-mesh sieve. The feed quantity of the pulverized coal is 30 kg/h and the furnace has an inner diameter of 700 mm and a length of 2 m. The feed quantity of the pulverized coal from each fuel nozzle 11, 13 is at an equal rate of 15 kg/h. That is, this is the ratio obtained under the experimental condition where the ratio of the air quantity jetted from the primary fuel nozzle 11 and the minimum air quantity necessary for completely burning the pulverized coal jetted from the primary fuel nozzle 11 is set to 0.2.

As seen from FIG. 4, when the swirl flow generator 15 is used, $NO_x$ generated in the furnace can be reduced about 100 ppm compared to when the swirl flow generator is not used.

Figure 5:
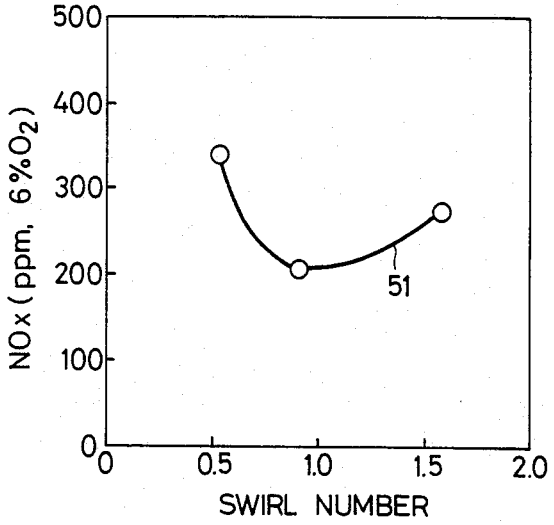
FIG. 5 is a graph showing the relation between the swirl number and the $NO_x$ when the coal is burnt using the burner of the present invention.

Referring to FIG. 5, 51 represents the characteristic curve when the air nozzle 14 is not used, the speed $V_1$ is 25 m/sec, and $f_2/(f_1+f_2)$ is 0.25. As it is preferable that the amount of $NO_x$ is 225 ppm at 6% $O_2$, the swirl number is preferably approximately 0.75 to 1.3.

Figure 6:
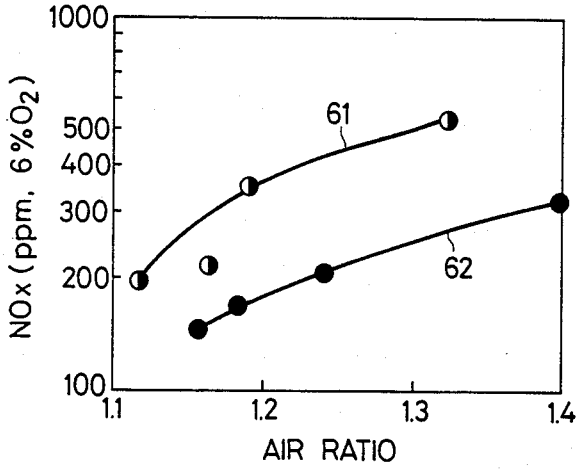
FIG. 6 is a graph showing the relation between the air ratio and $NO_x$ when the coal is burnt using the burner of the present invention.

FIG. 6 illustrates the quantity of $NO_x$ generated when the pulverized coals are burnt and the air is supplied from air nozzles 14 using the burner shown in FIGS. 1 and 2.

The abscissa of FIG. 6 represents an air ratio which is the quotient of the sum of the air quantities jetted from the nozzles 11, 13, 14 divided by the minimum air quantity necessary for completely burning the pulverized coal jetted from each of the primary and secondary fuel nozzles 11, 13. The ordinate represents the $NO_x$ concentration in the combustion exhaust gas. In FIG. 6, 61 represents the characteristic curve when the air nozzles 14 have no swirl angle as shown in FIGS. 1 and 2, and the swirl number at the air nozzle 14 is zero. 62 represents the characteristic curve when the swirl angle of the air nozzles 14 or the third air nozzles is formed 90° and the swirl number at the nozzles is 1.08. In each curve, the velocity $V_1$ is 23 m/sec, the swirl angle of the swirl means 15 is formed 60°, and the secondary fuel ratio $f_2/(f_1+f_2)$ is 0.2. As seen from FIG. 6, the amount of $NO_x$ can be reduced approximately 170 ppm at the same air ratio with the use of a swirl angle of the air nozzles 14 of 90° as compared with no swirl angle.

Figure 7:
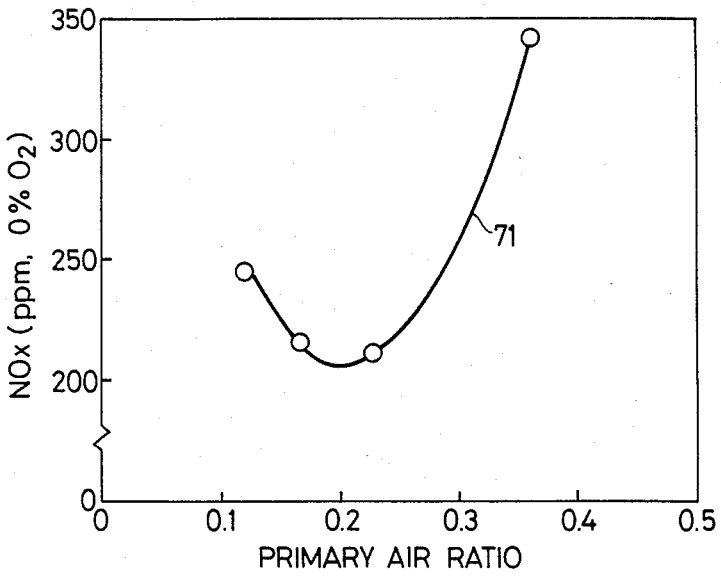
FIG. 7 is a graph showing the relation between the air ratio of the primary fuel nozzle and $NO_x$ when the coal is burnt using the burner of the present invention.

FIG. 7 illustrates an example where the feed quantity of the pulverized coal from each fuel nozzle 11, 13 is at an equal level of 15 kg/h, but the overall air ratio $\lambda$ is kept at a constant level of about 1.3 and the air ratio $\lambda_1$ of the internal flame formed by the fuel and air jetted from the primary fuel nozzle 11 is changed (hereinafter, this ratio will be referred to as the "primary air ratio"). To keep the overall air ratio $\lambda$ constant, the air quantity from the air nozzle 14 is changed in accordance with the change of the primary air ratio $\lambda_1$.

The abscissa in FIG. 7 represents the primary air ratio $\lambda_1$ and the ordinate does the $NO_x$ concentration in the combustion exhaust gas. It can be understood from the curve 71 that an optimal value exists for the primary air ratio $\lambda_1$ and a primary air ratio $\lambda_1$, at which $NO_x$ becomes minimal, also exists. The primary air ratio $\lambda_1$ at which $NO_x$ becomes minimal is a value below 1 and becomes substantially minimal at about 0.1 to 0.3. The result means that $NO_x$ can be reduced effectively by keeping the internal flame formed by the fuel jetted from the primary fuel nozzle 11 in a reducing atmosphere while keeping the external flame formed by the fuel jetted from the secondary fuel nozzle 13 within the complete combustion range of the air ratio of more than 1 and more particularly, at least 2.

Figure 8:
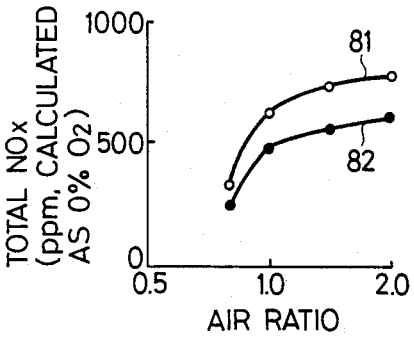
FIG. 8 is a graph showing the relation between the air ratio and the whole $NO_x$ when the coal is burnt in a heating furnace.
Figure 9:
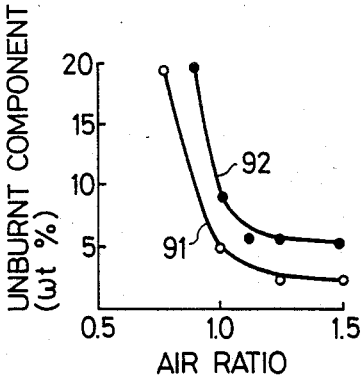
FIG. 9 is a graph showing the air ratio and the unburnt component.
Figure 10:
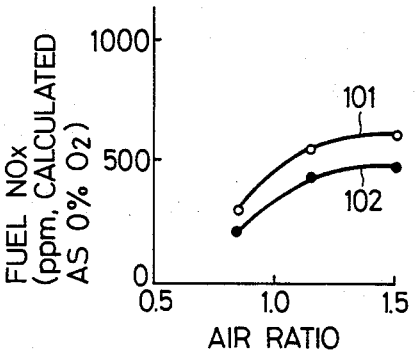
FIG. 10 is a graph showing the relation between the air ratio and fuel $NO_x$.

Next, FIGS. 8 through 10 illustrate the formation of $NO_x$, unburnt components in the combustion ash and the formation characteristics of thermal $NO_x$ formed upon oxidation of the N content in the coal when the air for combustion and the fuel coal are mixed in advance and this mixed gas flow is supplied into a heating furnace at 1,600° C., respectively. The coal used is Teiheiyo Coal of Japan, and the heating furnace has an inner diameter of 50 mm and a heating portion of 800 mm long. The combustion air flow rate is 20 Nl/min and the air ratio is adjusted by changing the feed coal quantity. The fuel $NO_x$ is obtained from the difference between $NO_x$ formed when combustion is made using the air and $NO_x$ formed when argon-oxygen synthetic gas is used for combustion. Curves 81, 91, 101, 111 in FIGS. 8 through 11 represents the results when fine pulverized coal having a particle size of up to 74 $\mu$m is burnt while curves 82, 92, 102, 112 represent the results when coarse pulverized coal having a particle size of more than 105 $\mu$m is burnt. It can be seen that when comparison is made at the same air ratio shown in FIG. 8, the quantity of the whole $NO_x$ (sum of fuel $NO_x$ and thermal $NO_x$) is greater in the case of the combustion of fine pulverized coal than in the case of the combustion of coarse pulverized coal. FIG. 9 illustrates the relation between the air ratio and the unburnt components in the combustion ash, the latter tending to increase in the combustion of the coarse pulverized coal. The unburnt components in the combustion ash increases drastically at the air ratio of 1 or below. They depend greatly upon the air ratio.

Figure 11:
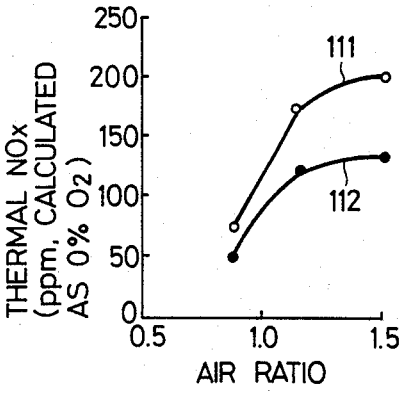
FIG. 11 is a graph showing the relation between the air ratio and thermal $NO_x$.

FIG. 10 illustrates the relation of the fuel $NO_x$ formed as a result of oxidation of the N component in the coal and the air ratio. It can be seen from the comparison of the curve 101 with 102 that the generation quantity of the fuel $NO_x$ is greater in the case of the fine pulverized coal than in the case of the coarse pulverized coal. Further, FIG. 11 shows the relation between the thermal $NO_x$ and the air ratio. In the same way as in FIG. 10, it can be understood that the thermal $NO_x$ is also greater for the fine pulverized coal than for the coarse pulverized coal.

The present invention will be described in further detail using the burner shown in FIG. 1 on the basis of FIGS. 8 through 11. When burning the fine pulverized coal using the burner shown in FIG. 1, the fuel coal pulverized to the pulverized coal is separated into the fine coal and the coarse coal and the fine coal is used as the primary fuel and the coarse coal, as the secondary fuel. Since the coarse coal is used as the secondary fuel, the coarse coal which is apt to form a large quantity of unburnt components in the combustion ash, can be burnt at a high air ratio, whereby the increase of the burnt components can be restricted. At the same time, since the $NO_x$ formation quantity is smaller for the coarse coal than for the fine coal, $NO_x$ can be reduced as compared with when the fine coal is burnt at a high air ratio. Moreover, since the fine coal having a greater $NO_x$ generation quantity is used as the primary fuel and is burnt at a low air ratio so as to utilize it for forming an $NO_x$ reducing agent, the formation of $NO_x$ can be restricted. Further, since the internal flame burning at a low air ratio is encompassed therearound by the external flame of a high air ratio, the reaction in the internal flame is promoted by the heat of radiation from the external flame. Since the recycling flow is generated from the external flame to the internal flame in the region where the swirl flow applied to the external flame decays, mixing between the excessive oxygen in the external flame and the unburnt component generated in the internal flame is promoted and emission of the unburnt component can be restricted.

The present invention makes it possible to clearly divide the combustion flame of the pulverized coal into the $NO_x$ formation region and the reducing substance formation region for reducing $NO_x$ and can promote mixing of the reaction products from both regions. Accordingly, the present invention can reduce $NO_x$ as well as emission of the unburnt components.

What is claimed is:

1. A fuel jet method for a pulverized coal burner comprising the steps of:

(a) jetting a first coal in fine powder form with an air ratio of 0.1 to 0.3, (b) jetting and swirling a second coal in a coarse powder form with an air ratio of 1 to 2 from a first outer circumferential portion of said first coal a first swirling of said second coal being performed in a swirl number, which is equal to momentum of the first swirling stream of said second coal per momentum toward a straight direction of said second coal, of 0.75 to 1.3, and a swirl angle of said first swirl being from 45° to 90° along an axis of the burner, and (c) jetting and swirling air from a second outer circumferential portion of said first swirling stream of said second coal, the speed of the second swirling of said air at an outermost circumferential portion of said second swirling stream of said air being faster than that at an inner circumferential portion of said second swirling stream, and a swirl angle of said second swirl being from 45° to 90° along an axis of the burner.

* * * * *